US007168347B2

(12) United States Patent
Hsieh

(10) Patent No.: US 7,168,347 B2
(45) Date of Patent: Jan. 30, 2007

(54) WRENCH OPENING

(76) Inventor: Chih Ching Hsieh, 235 Chung-Ho Box 8-24, Taipei (TW)

( * ) Notice: Subject to any disclaimer, the term of this patent is extended or adjusted under 35 U.S.C. 154(b) by 158 days.

(21) Appl. No.: 10/899,435

(22) Filed: Jul. 26, 2004

(65) Prior Publication Data

US 2004/0255728 A1 Dec. 23, 2004

Related U.S. Application Data

(63) Continuation-in-part of application No. 10/211,645, filed on Aug. 5, 2002, now abandoned.

(51) Int. Cl.
*B25B 13/00* (2006.01)

(52) U.S. Cl. ..... 81/186; 81/120; 81/121.1

(58) Field of Classification Search ..... 81/186, 81/120, 121.1, 119
See application file for complete search history.

(56) References Cited

U.S. PATENT DOCUMENTS 3,903,764 A * 9/1975 Andersen ..... 81/121.1
5,476,024 A * 12/1995 Hsieh ..... 81/121.1
D398,823 S * 9/1998 Hsieh ..... D8/29
5,832,792 A * 11/1998 Hsieh ..... 81/124.6
5,860,339 A * 1/1999 Mikic et al. ..... 81/186
6,029,548 A * 2/2000 Hsieh ..... 81/166
6,098,501 A * 8/2000 Sundstrom ..... 81/121.1
6,899,000 B1 * 5/2005 Hsien ..... 81/176.2
6,962,100 B2 * 11/2005 Hsien ..... 81/186
2003/0209110 A1 * 11/2003 Huang ..... 81/119
2004/0020332 A1 * 2/2004 Hsieh ..... 81/186
2004/0255728 A1 * 12/2004 Hsieh ..... 81/186
2005/0092139 A1 * 5/2005 Hsien ..... 81/186
2005/0103169 A1 * 5/2005 Hu ..... 81/186

* cited by examiner

*Primary Examiner*—Lee D. Wilson

(57) ABSTRACT

A wrench is cooperated with a fastener. The fastener has a plurality of surfaces jointed with each other at respective corners of the fastener. The wrench has a driving cylindrical member including an enclosed opening formed therein and having six corner spaces and six sides provided therein. Each of the six sides of the driving cylindrical member includes two cambered bulges formed and provided therein for engaging with the surfaces of the fastener, and a recess is formed between said cambered bulges.

9 Claims, 12 Drawing Sheets

WRENCH OPENING

This is a continuation in part of U.S. patent Ser. No. 10/211,645 filed Aug. 5, 2002, now abandoned, assigned to and invented by the inventor of the present invention. The contents of the U. S. patent Ser. No. 10/211,645 are incorporated into the present invention as a part of the present invention.

BACKGROUND OF THE INVENTION

1. Field of the Invention

The present invention relates to a wrench, and more particularly to a wrench having a wrench opening for engaging with the flat surfaces of the fasteners.

2. Description of the Prior Art

Various kinds of typical wrenches have been developed for driving hexagonal fasteners which have a plurality of substantially flat and planar surfaces that join each other at respective edges or corners of the fasteners.

For example, U.S. Pat. No. 3,903,764 assigned to Andersen, U.S. Pat. No. 4,765,211 assigned to Colvin, U.S. Pat. No. 5,219,392 assigned to Ruzicka et al., U.S. Pat. No. 5,388,486 assigned to Ruzicka et al, and U.S. Pat. No. 5,476,024 assigned to Hsieh, disclose several of the typical wrenches and comprise a substantially hexagonal wrench opening formed therein, and having rounded spaces formed in the corners for receiving the corners of the fasteners, and for allowing the fasteners to be slightly rotated relative to the wrench.

The typical wrenches comprise a number of edges or teeth or cambered bulges for engaging with the corners of the fasteners, and for driving or rotating the fasteners. However, when the edges or the corners of the fasteners are rounded or have been worn out, the fasteners may no longer be rotated or driven by the typical wrenches.

Some of the typical wrenches have rounded or curved cambered bulges extended into the wrench opening for engaging with the planer surfaces of the fasteners. However, when the wrench is rotated relative to the fastener, the edges or the corners of the fasteners will also be rotated to engage with the wrench so as to be driven by the wrench, such that the fastener can be driven by the wrench. The wrench may also no be used for rotating or driven the fasteners having rounded corners or worn out corners.

The present invention has aimed to mitigate and/or obviate the afore-described disadvantages of the conventional wrenches.

SUMMARY OF THE INVENTION

The primary objective of the present invention is to provide a wrench including a wrench opening for engaging with the flat surfaces of the fasteners instead of engaging with the corners or the fasteners, and for allowing the wrench to drive the fasteners when the corners of the fasteners are rounded or have been worn out.

In accordance with one aspect of the invention, there is provided a wrench cooperating with a fastener, wherein the fastener includes a plurality of surfaces joining each other at respective corners of the fasteners, the wrench comprising a driving cylindrical member including an enclosed opening formed therein and having six sides provided therein, the six sides of the driving cylindrical member each including two cambered bulges formed and provided therein for engaging with the surfaces of the fastener, and a recess formed between the cambered bulges respectively.

The driving cylindrical member further includes three projections extended in the recesses thereof respectively and extended and disposed between the cambered bulges.

The wrench includes a handle having a first end and a second end, a driving cylindrical member disposed on the first and of the handle, and a head provided on the second end of the handle, the head includes an open opening formed and defined between two parallel wrench flats, and two cambered bulges extended from each of the wrench flats respectively, and a recess formed between the cambered bulges respectively, for allowing the cambered bulges to engage with a middle portion of the surface of the fastener that is spaced from the corners of the fastener.

The head include two projections extended in the recesses thereof respectively and extended and disposed between the cambered bulges of each of wrench flats of the head.

Further objectives and advantages of the present invention will become apparent from a careful reading of a detailed description provided hereinbelow, with appropriate reference to accompanying drawings.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
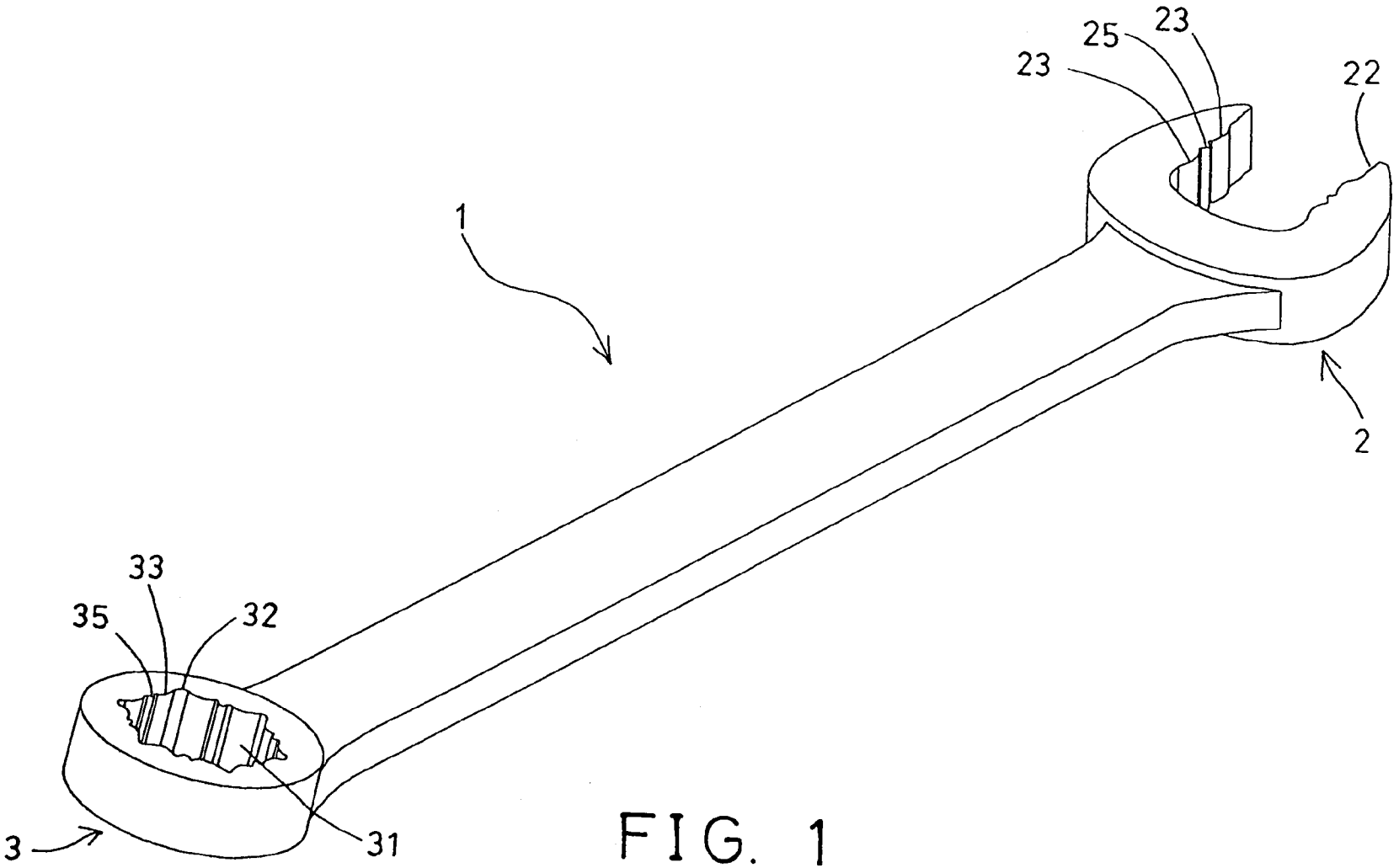
FIG. 1 is a perspective view of a wrench in accordance with the present invention.
Figure 2:
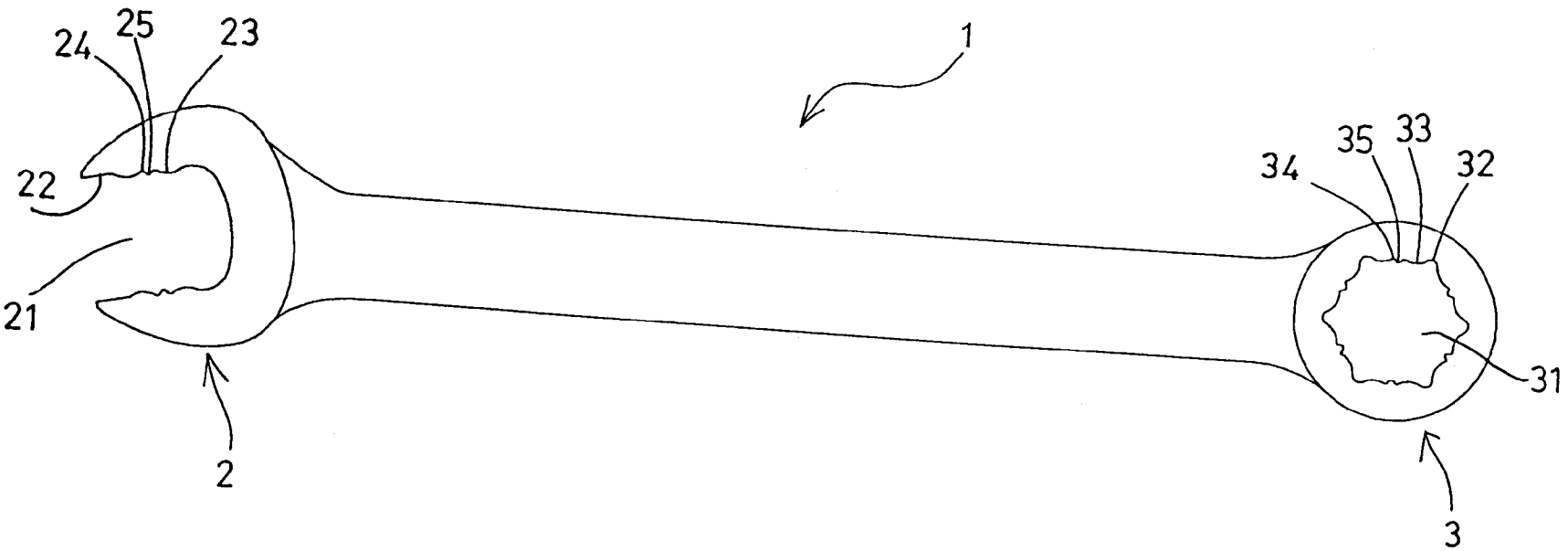
FIG. 2 is a top plan view of the wrench.

Referring to the drawings, and initially to FIGS. 1 and 2, a wrench in accordance with the present invention heads 2, 3 provided on one or both the ends thereof, for receiving and for driving hexagonal fasteners 4 (FIGS. 3–6).

For example, the fasteners 4 each has a plurality of or three pairs of substantially flat and planar surfaces 41 that join each other at respective edges or corners 42 of the fasteners 4. For example, the head 2 includes an open opening 21 formed therein, and the other head 3 includes an enclosed opening 31 formed therein for receiving the fasteners 4.

The driving head 2 includes two wrench flats 22 which are parallel to each other and spaced apart a sufficient distance to loosely accommodate the confronting flat surfaces 41 of the hexagonal fastener 4, and two rounded cambered bulges 23 extended from each of the wrench flats 22 respectively, such as extended from the middle portions of the wrench flats 22 respectively, and a curved recess 24 formed between the cambered bulges 23 of the respective wrench flats 22 (FIGS. 9, 10, 12, 14).

As shown in FIGS. 1, 2, 4 and 6, the driving head 2 further includes a projection 25 extended in the curved recess 24 thereof and located between the rounded cambered bulges 23, and preferably steeper than that of the rounded cambered bulges 23, for engaging with the middle portions of the respective edges or corners 42 of the fasteners 4.

Figure 4:
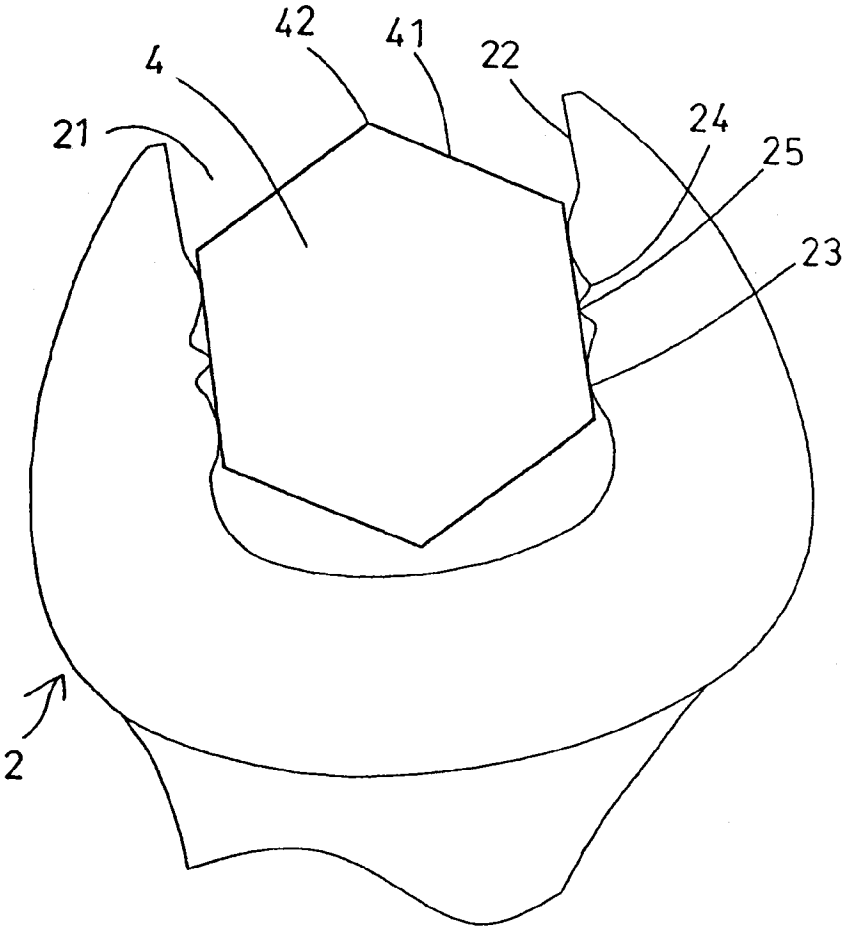
Figure 5:
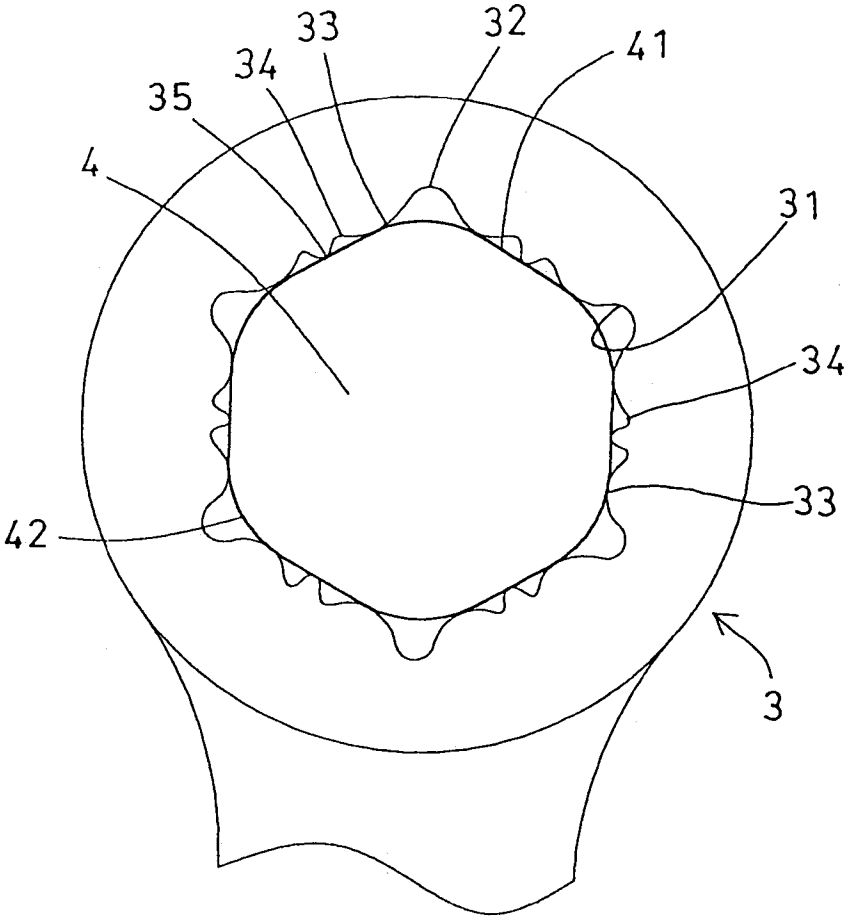
Figure 6:
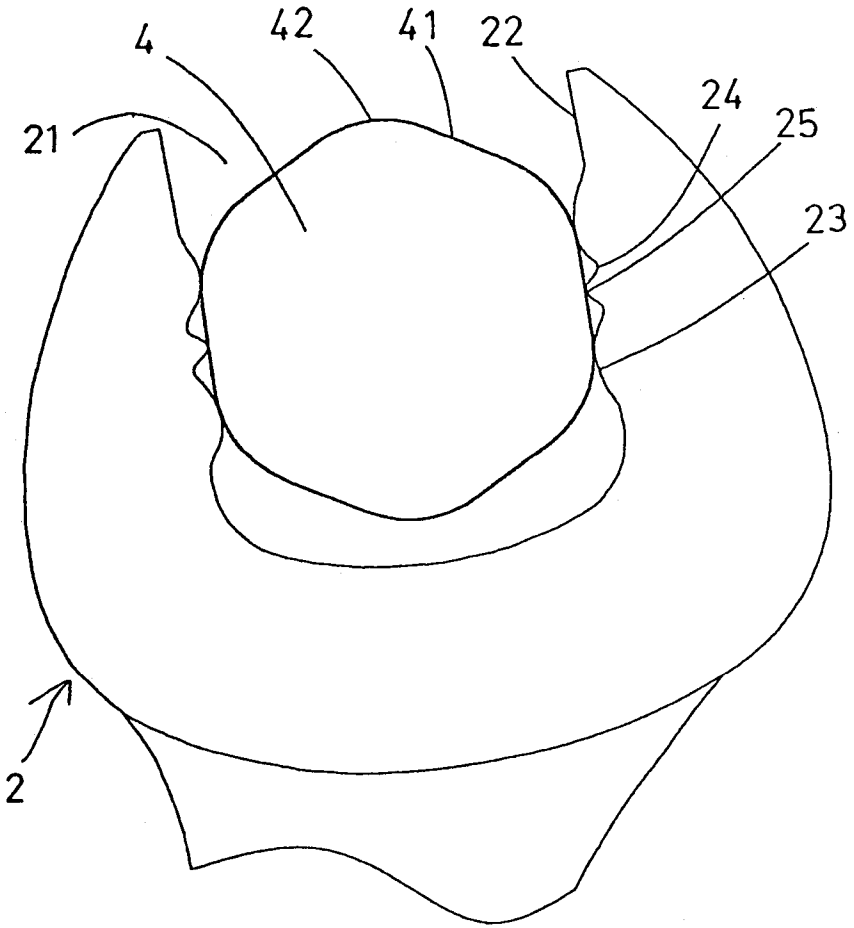
Figure 12:
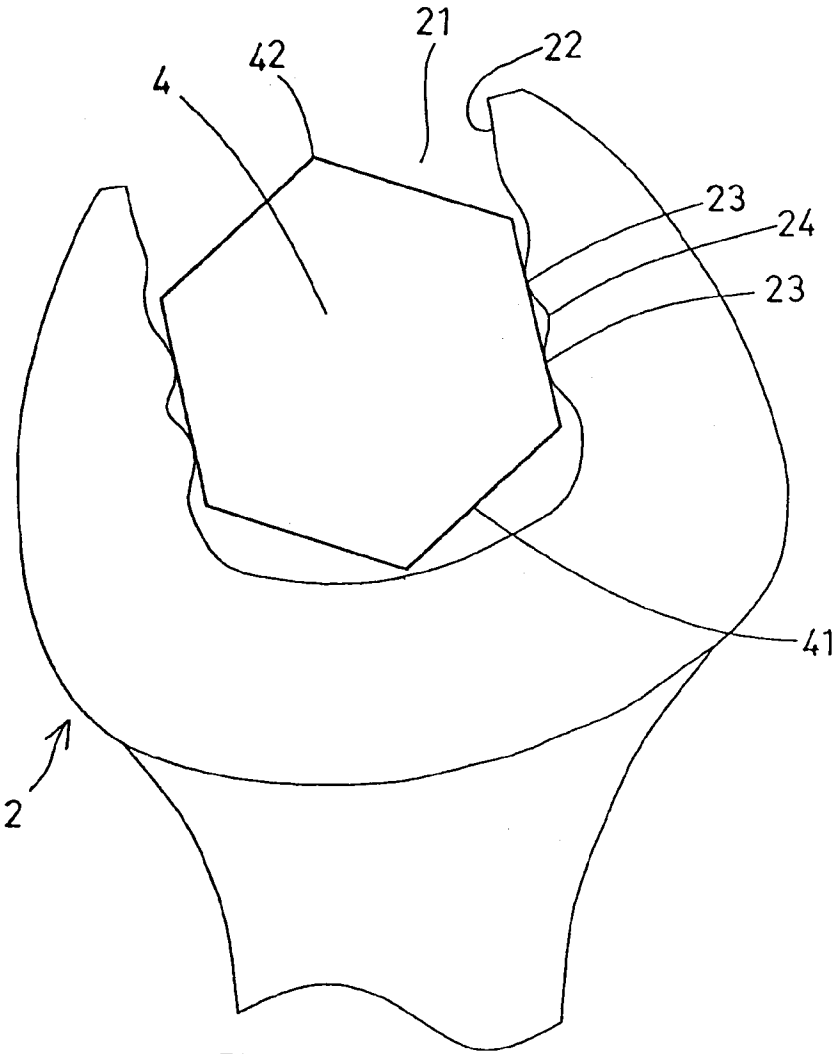
Figure 13:
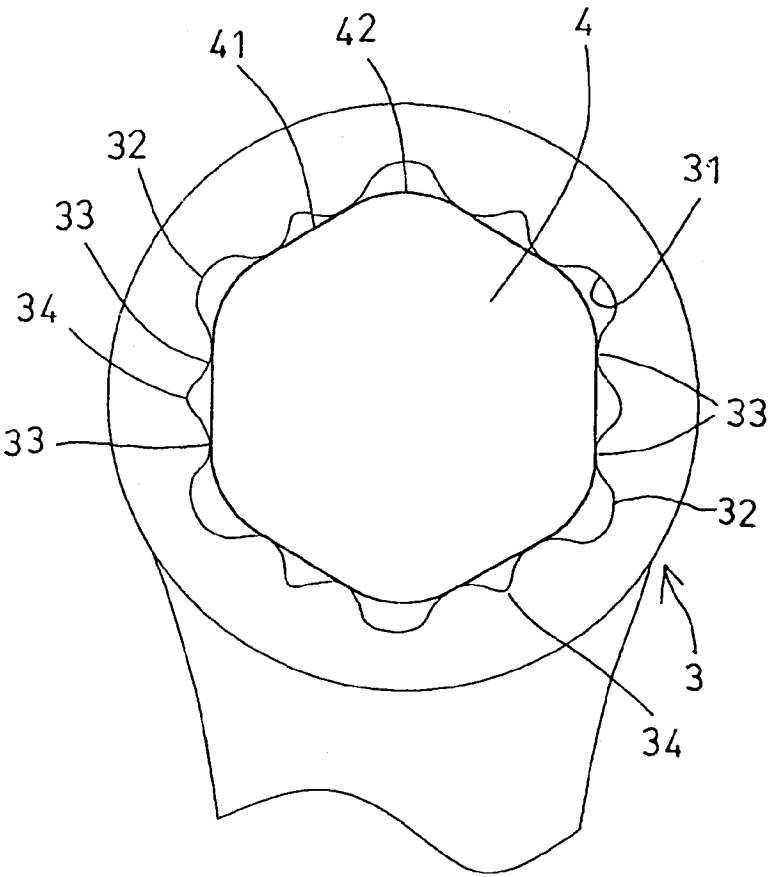
Figure 14:
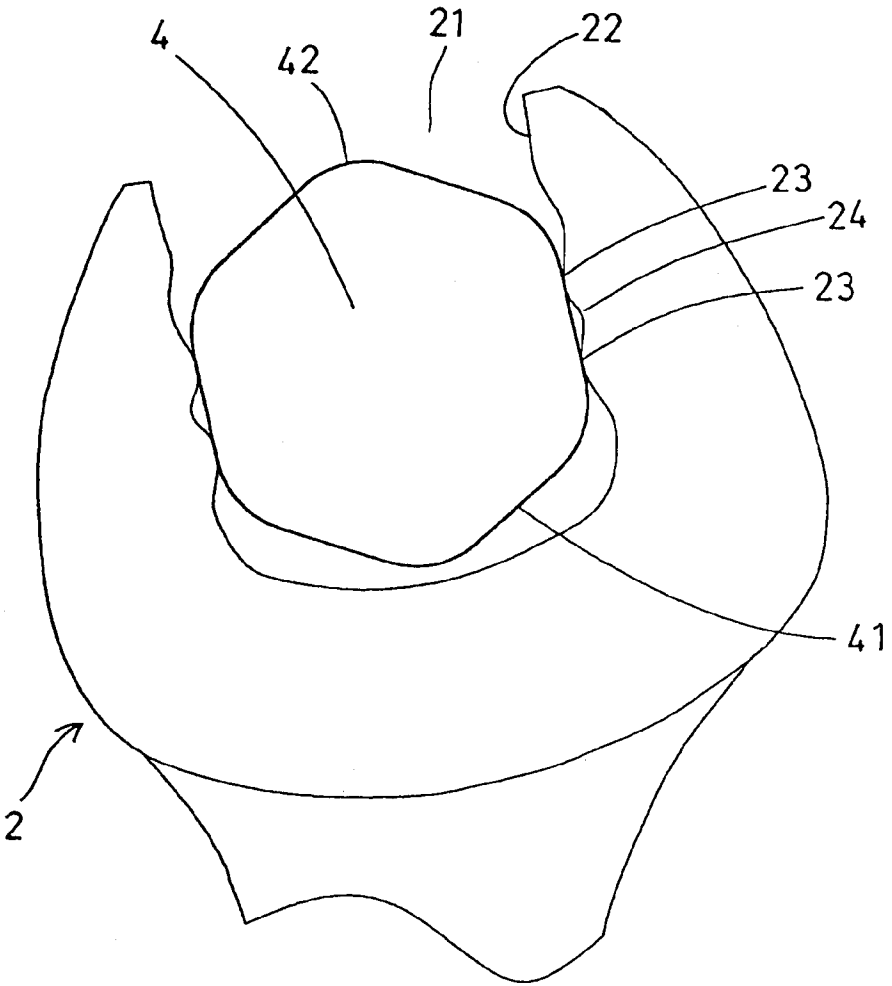

In operation, as shown in FIGS. 4, 12, when the head 2 is rotated relative to the fastener 4, the rounded cambered bulges 23 end/or the steeper projection 25 of the driving head 2 may be driven to engage with the inner or middle portions of the flat surfaces 41 of the fasteners 4 that are spaced from the corners 42 of the fasteners 4, and will not be engaged with the corners 42 of the fasteners 4, such that the driving head 2 may also be used to rotate or to drive the fasteners 4 having rounded or worn out corners 42, as shown in FIGS. 6, 14.

The driving head 3 includes six corner spaces 32 formed or provided in the enclosed opening 31 thereof for receiving the corners 41 of the fastener 4, and includes six sides each having two rounded cambered bulges 33 extended inwardly into the enclosed opening 31 thereof and a curved recess 34 formed between the cambered bulges 33 of the respective sides of the driving head 3 (FIGS. 9–11, 13).

As shown in FIGS. 1–3, and 5, the driving head 3 further includes a projection 35 extended in each of the curved recesses 34 thereof the located between the rounded cambered bulges 33, and preferably steeper than that of the rounded cambered bulges 33, for engaging with the middle portions of the respective edges or corners 42 of the fasteners 4.

Figure 3:
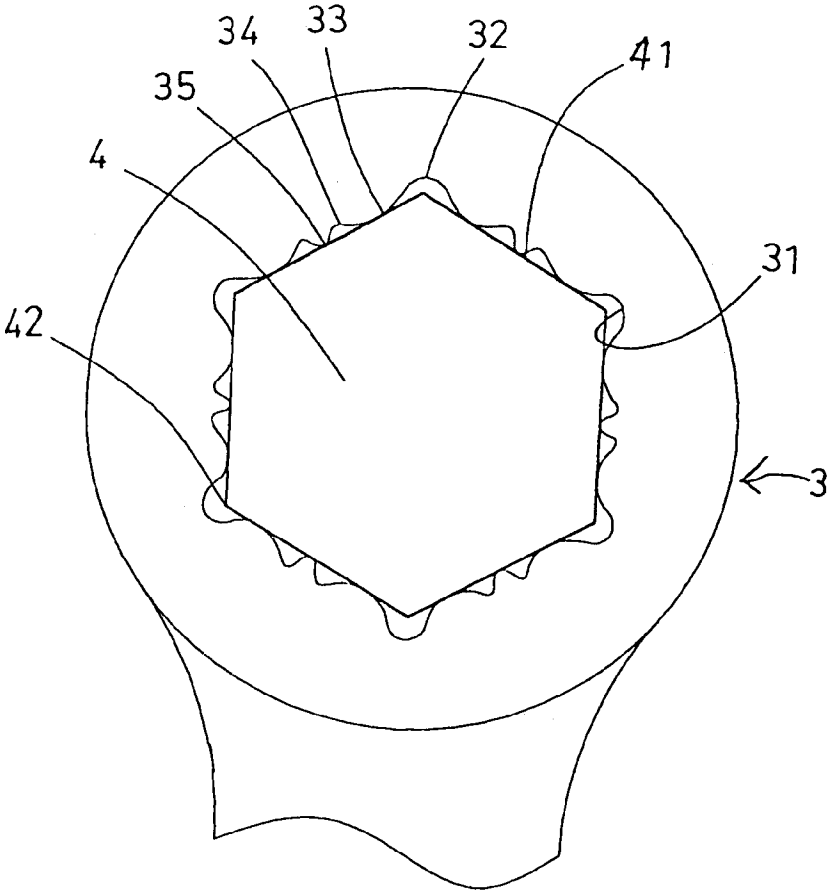
FIGS. 3, 4, 5, 6 are partial top plan views illustrating the operation of the wrench.
Figure 11:
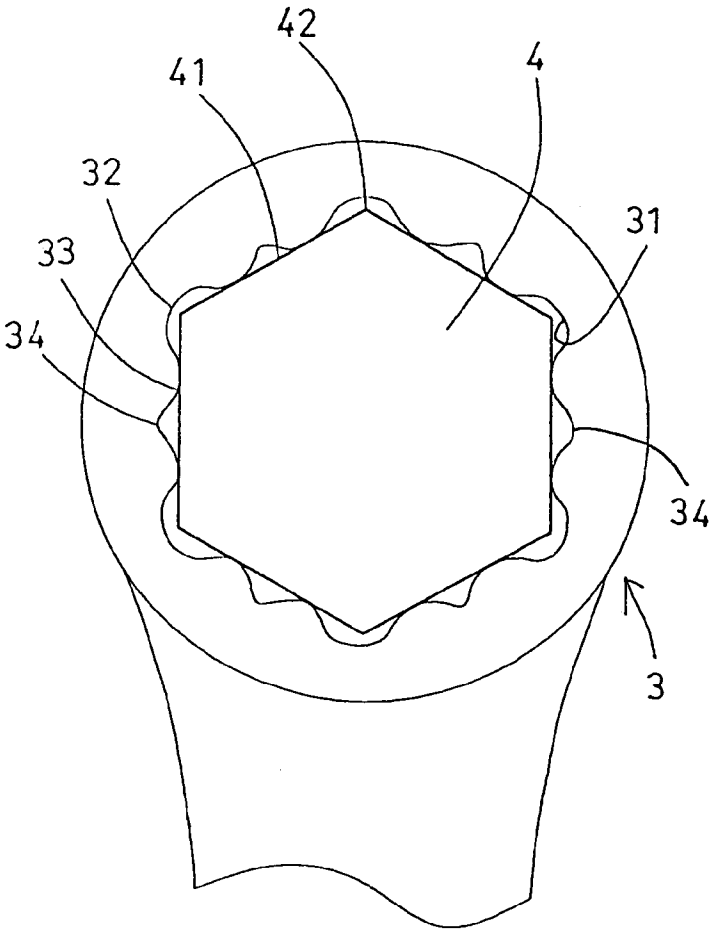
FIGS. 11, 12, 13, 14 are partial top plan views illustrating the operation of the wrench as shown in FIGS. 9 and 10.

In operation, as shown in FIGS. 3, 11, when the head 3 is rotated relative to the fastener 4, the rounded cambered bulges 33 and/or the steeper projection 35 of the driving head 3 may be caused to engage with the inner or middle portions or the flat surfaces 41 of the fasteners 4 that are spaced from the corners 42 of the fasteners 4, and will not be engaged with the corners 42 of the fasteners 4, such that the driving head 3 may also be used to rotate or to drive the fasteners 4 having rounded or worn out corners 42, as shown in FIGS. 6, 14.

Figure 15:
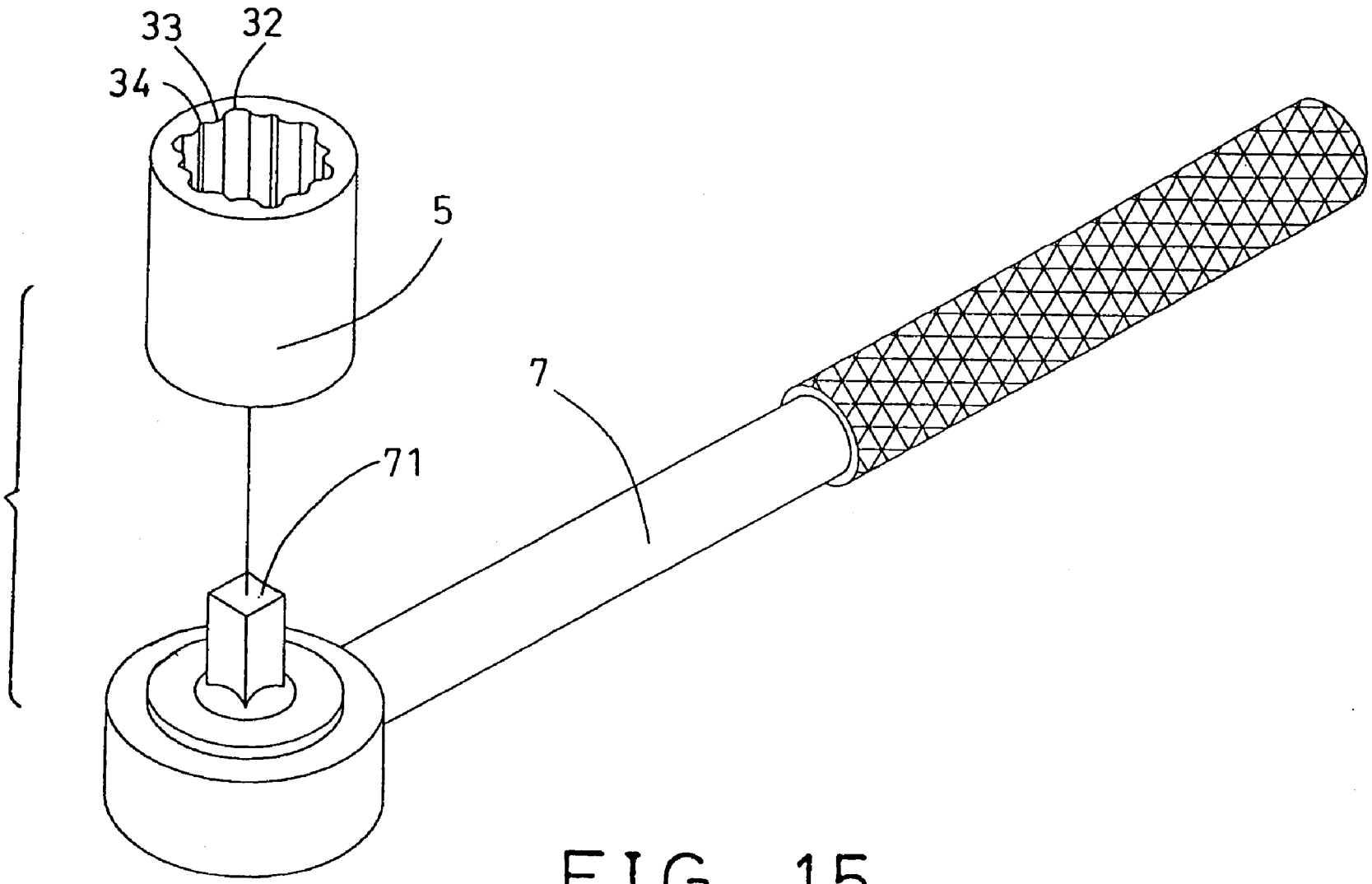
FIG. 15 is a partial exploded view illustrating a socket having a wrench opening similar to that shown in FIGS. 9–11 and 13.
Figure 16:
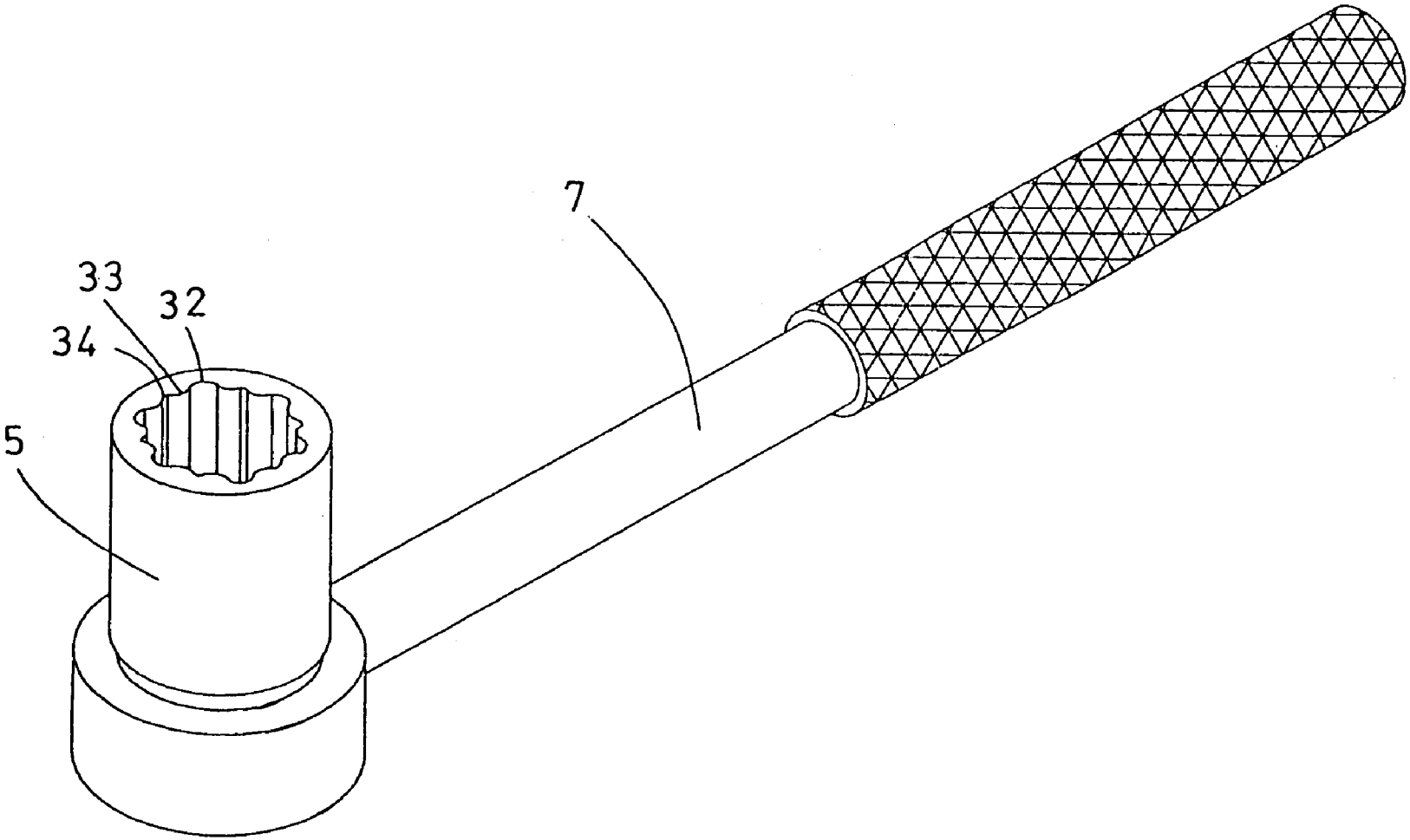
FIG. 16 is a perspective view illustrating the operation of the socket as shown in FIG. 15 to be driven by a wrench tool.

Referring next to FIGS. 15 and 16, the driving socket or the wrench socket 5 may also include a body or a head having an enclosed opening 31 as that of the head 3, and may also include six corner spaces 32 and six cambered bulges 33 extended or provided in the enclosed opening 31 thereof. The wrench socket 5 may be rotated or driven by the driving shank 71 of the wrench tools 7, and the cambered bulges 33 may also be used to engage with the inner or middle portions of the flat surfaces 41 of the fasteners 4 that are spaced from the corners 42 of the fasteners 4, such that the wrench socket 5 may also be used to rotate or to drive the fasteners 4 having rounded or worn out corners 42.

Figure 7:
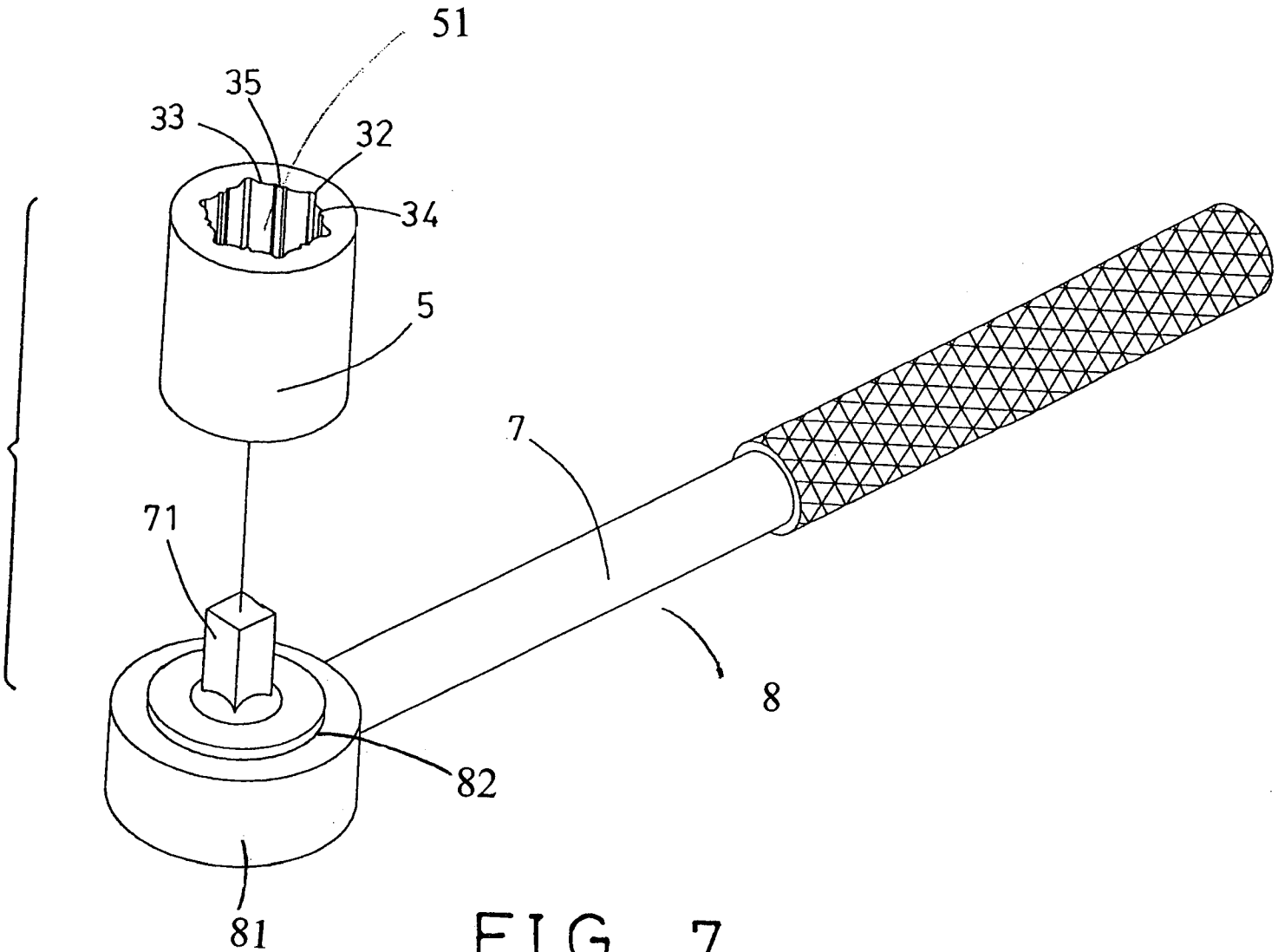
FIG. 7 is a partial exploded view illustrating a socket having a wrench opening of the present invention.
Figure 8:
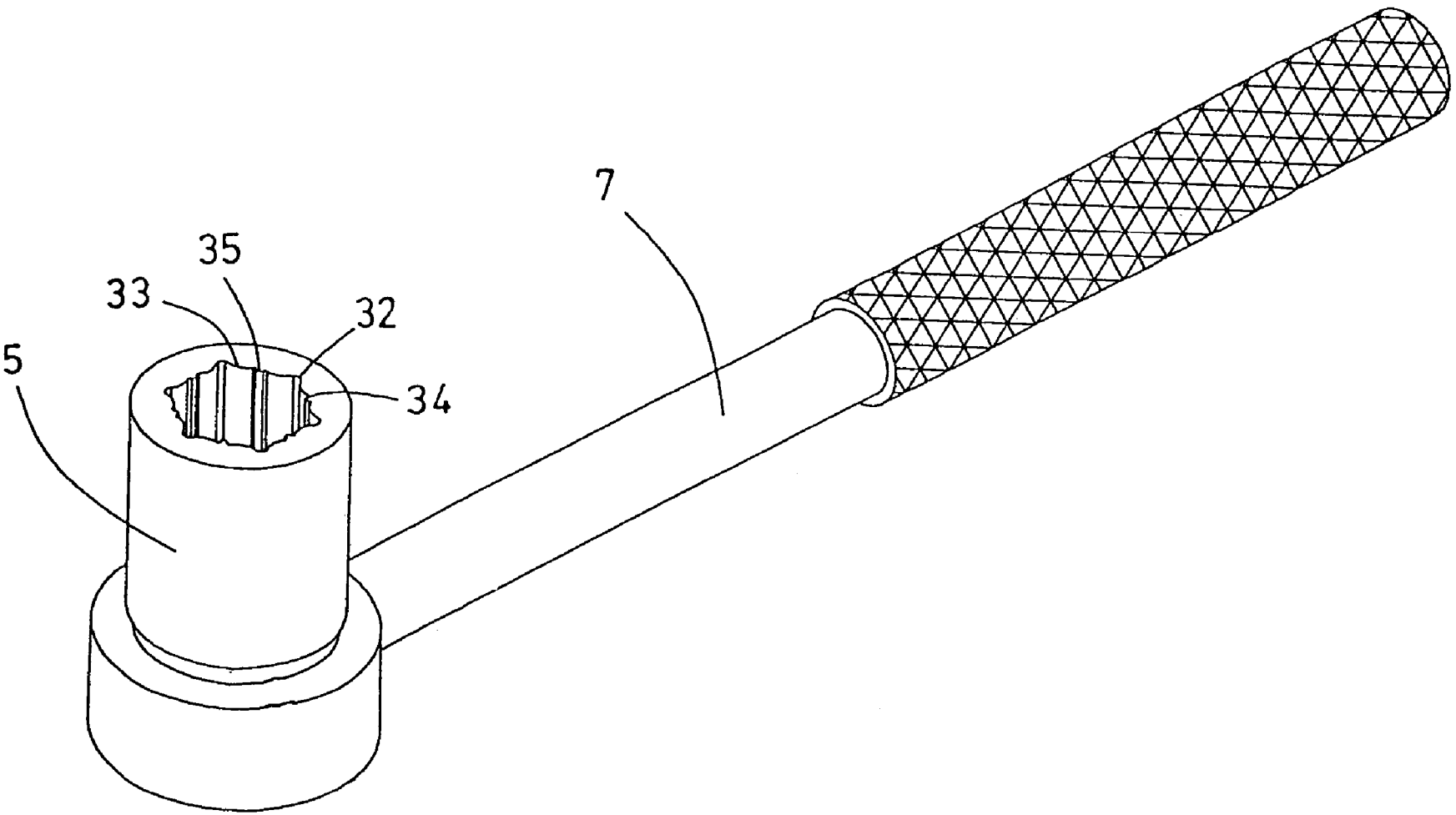
FIG. 8 is a perspective view illustrating the operation of the socket are shown in FIG. 7 to be driven by a wrench tool.
Figure 9:
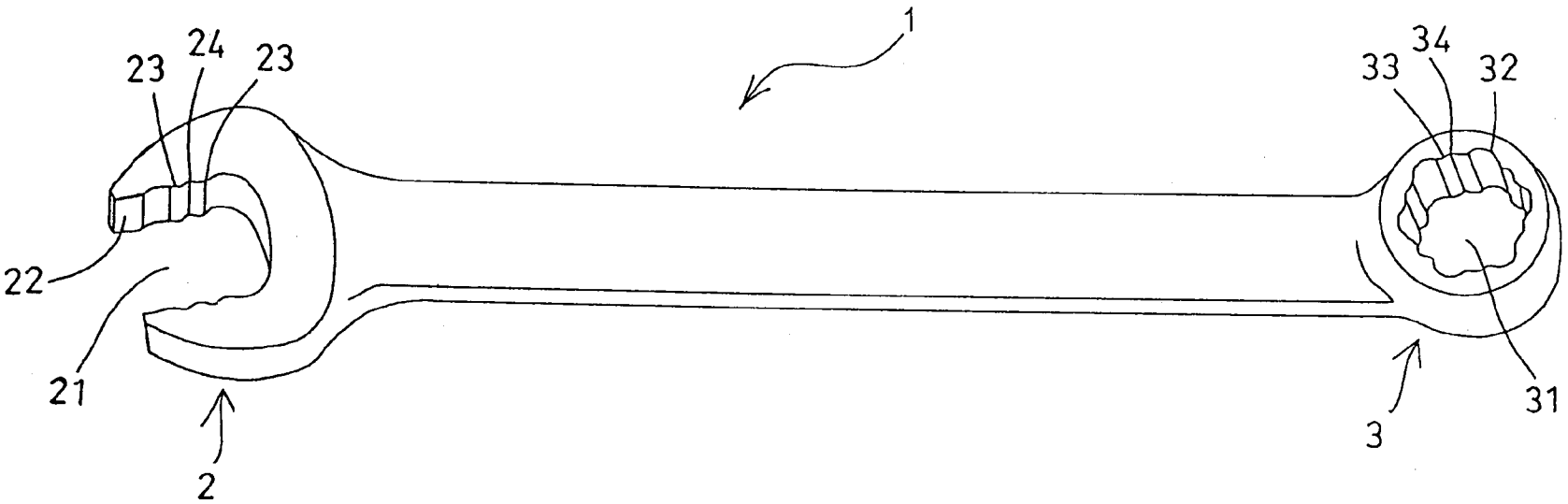
FIG. 9 is a perspective view illustrating another embodiment of the wrench.
Figure 10:
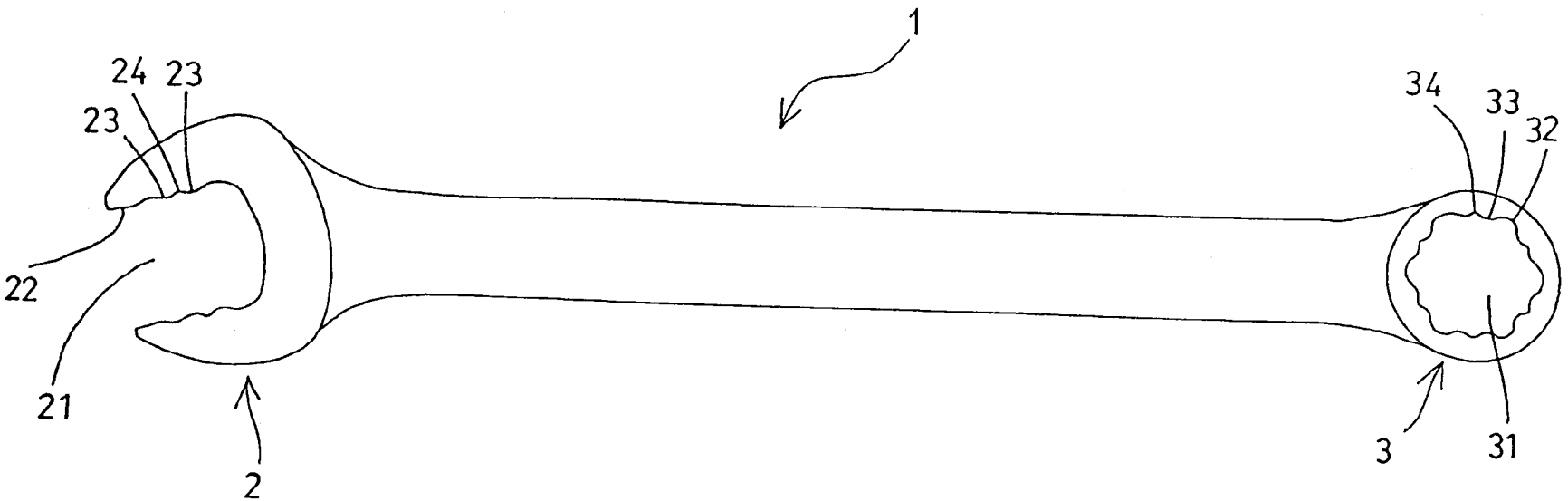
FIG. 10 is a top plan view of the wrench as shown in FIG. 9.

With reference to FIGS. 7, 15, and 16, a wrench 8 comprises a first head 81 at one end and the head having an opening 82; a rectangular driving shank 71 inserted into the opening 82 of the first head 8 and one end of the rectangular driving shank 71 protruding from the opening 82 of the head 7;

A driving cylindrical member 5 with an inner hole 51; upper side of the inner hole 51 being a hexagonal hole; a lower side of the driving cylindrical member 5 being engaged with the rectangular driving shank, The hexagonal hole has six sides, each side being formed as a drive surface; the connection between two drive surfaces are cambered to reduce into the wall of the driving cylindrical member; and each side have two outward cambered bulges;

In any cross section area across a plane cut through an axis of the cylindrical shank; each side of the hexagonal hole is formed by a plurality of cambered bulges so that no straight portion and sharp portion is formed on the cross section; thereby, any object within the cylindrical member will not be damaged as a force applied to the wrench is too larger.

There are two cambered bulges. One steep protrusion can be located between two cambered bulges. The driving cylindrical member is a driving socket.

Accordingly, the wrench in accordance with the present invention includes a wrench opening for engaging with the flat surfaces of the fasteners instead of engaging with the corners of the fasteners, and for allowing the wrench to drive the fasteners when the corners of the fasteners are rounded or have been worn out.

Although this invention has been described with a certain degree of particularity, it is to be understood that the present disclosure has been made by may of example only and that numerous changes in the detailed construction and the combination and arrangement of parts may be resorted to without departing from the spirit and scope of the invention as hereinafter claimed.

What is claimed is:

1. A wrench cooperating with a fastener, the fastener having a plurality of surfaces joint each other at respective corners of the fastener, the wrench comprising:

a driving cylindrical member including an enclosed opening formed therein and having six corner spaces and six sides provided therein, a cross section of each of said six sides of said driving cylindrical member including two convex cambered bulges formed and provided therein for engaging with the surfaces of the fastener, and a recess formed between said cambered bulges respectively: wherein the cross section of each side of the driving cylindrical member has no straight flat portion.

2. The wrench according to claim 1, wherein between two said cambered bulges is installed with a cambered convex projection which has a size smaller than that of each cambered bulge and has a cambered end.

3. The wrench according to claim 1, wherein said driving cylindrical member is a driving socket.

4. The wrench according to claim 1, wherein said wrench includes a handle having a first and a second ends, and having said driving cylindrical member disposed on said first end of said handle, and having a head provided on said second end of said handle, said head includes an open opening farmed and defined between two parallel wrench flats, and two convex cambered bulges extended from each of said wrench flats of said head respectively, and a recess formed between said cambered bulges of said head respectively, for allowing said cambered bulges of said head to engage with a middle portion of the surface of the fastener that is spaced from the corners of the fastener: wherein the cross section of each side of the driving cylindrical member has no straight flat portion.

5. The wrench according to 4, wherein two said cambered bulges of said head is installed with a projection which has a size smaller than that of each cambered bulge and has a cambered end.

6. A wrench comprising:

a first head at one end and the head having an opening;

a rectangular driving shank inserted into said opening of the first head and one end of the rectangular driving shank protruding from the opening of the head;

a driving cylindrical member with an inner hole; an upper side of the inner hole being a hexagonal hole; a lower side of said driving cylindrical member being engaged with said rectangular driving shank, wherein the hexagonal hole has six sides, a cross section of each side being formed as a drive surface; a connection between two drive surfaces is cambered to reduce into the wall of the driving cylindrical member; and each side have two outward cambered bulges: wherein the cross section of each side of the driving cylindrical member has no straight flat portion;

wherein in any cross section area across a plane cut through an axis of the cylindrical shank; each side of the hexagonal hole is formed by a plurality of cambered bulges so that no straight portion and sharp portion is formed on the cross section; thereby, an object within the cylindrical member will not be damaged as a force applied to the wrench is too larger.

7. The wrench according to claim 6, wherein there are two cambered bulges on each side of the hexagonal hole.

8. The wrench according to claim 6, wherein between two said cambered bulges is installed with a cambered convex projection which has a size smaller than that of each cambered bulge and has a cambered end.

9. The wrench according to claim 6, wherein said driving cylindrical member is a driving socket.

* * * * *